US005250364A

United States Patent [19]

Hector, Jr. et al.

[11] Patent Number: 5,250,364

[45] Date of Patent: Oct. 5, 1993

[54] ROLLED PRODUCT WITH TEXTURED SURFACE FOR IMPROVED LUBRICATION, FORMABILITY AND BRIGHTNESS

[75] Inventors: Louis G. Hector, Jr.; Simon Sheu, both of Murrysville, Pa.

[73] Assignee: Aluminum Company of America, Pittsburgh, Pa.

[21] Appl. No.: 829,484

[22] Filed: Feb. 3, 1992

[51] Int. Cl.[5] ..... B21D 53/00

[52] U.S. Cl. ..... 428/687; 428/923

[58] Field of Search ..... 428/600, 687, 923

[56] References Cited

U.S. PATENT DOCUMENTS

| | | | |
|---|---|---|---|
| 4,775,599 | 10/1988 | Matsuoka et al. | 428/687 |
| 4,783,378 | 11/1988 | Wakui et al. | 428/687 |
| 4,795,681 | 1/1989 | Furukawa et al. | 428/687 |
| 4,798,772 | 1/1989 | Furukawa | 428/687 |
| 4,917,962 | 4/1990 | Crahay et al. | 428/687 |
| 4,947,023 | 8/1990 | Minamida et al. | 219/121.68 |
| 4,996,113 | 2/1991 | Hector et al. | 428/600 |
| 5,025,547 | 6/1991 | Sheu et al. | 29/895.3 |

OTHER PUBLICATIONS

Minamida et al., "Laser System for Dulling Work Roll by Q-Switched Nd:YAG Laser", Journal of Laser Applications, vol. 1, No. 4, Oct., 1989, pp. 15-20.

*Primary Examiner*—John Zimmerman

*Attorney, Agent, or Firm*—Elroy Strickland

[57] ABSTRACT

A metal sheet for making rigid container products, and a method of making the sheet. The sheet has a fissureless surface that retains minute amounts of lubricant in generally uniformly spaced apart elongated micron-sized depressions, the depressions providing a quasi-isotropic surface texture which, in turn, provides a substantially uniform distribution of friction at the interface of the surfaces of the sheet and a tool employed to form the container products. The depressions, in addition, provide the product surface with a high degree of specular reflection of light and thus a bright surface having a high level of distinctness of an image reflected from the surface.

7 Claims, 4 Drawing Sheets

ROLLED PRODUCT WITH TEXTURED SURFACE FOR IMPROVED LUBRICATION, FORMABILITY AND BRIGHTNESS

BACKGROUND OF THE INVENTION

The present invention relates generally to metal strip or sheet employed in making rigid can bodies, ends (i.e., lids) and lid tabs, and particularly to a bright strip product that reflects light in a substantially specular manner and possesses the ability to carry in its surface a minute amount of lubricant into lid forming, deep drawing, and ironing processes.

Can manufacturing generally involves one or more drawing operations and one or more ironing operations, in the case of beverage cans. In the drawing process, which generally occurs prior to the ironing process, a (flat) sheet metal blank or disk is stretched and bent into a shallow cup with a cylindrical punch and die. This process may induce undesirable thickness nonuniformities in the cup sidewall. In order to render the sidewall thickness more uniform, as well as to increase the height of the cup so that it eventually becomes a can, the cup is passed through one or more ironing rings in an ironing process. The ironing process is generally conducted in a special machine known as a "bodymaker", which is usually separate from the drawing apparatus. The clearance between the ironing ring and the punch is generally less than the can sidewall thickness so as to ensure that the sidewall thickness is reduced with resultant elongation of the can.

Deep drawing involves further drawing of a cup using a second punch and die to increase cup depth.

In can manufacturing operations, the initial surface microtopography of aluminum or steel sheet alloys has a profound influence on the can forming process and on the resulting appearance of the can surface. This influence is manifested in the physics of the tooling/workpiece interface; this interface forms as a punch tool first engages the sheet (workpiece) to initiate formation of a can body or lid, until the can body or lid is completed. Important aspects of the interface physics during all phases of can forming and lid manufacture are the friction levels, wear debris generation, adhesive metal transfer to the workpiece surface, and tool surface wear. The frictional characteristics influence particularly the deformation of the flat sheet in the process of being plastically deformed under large strains into a partially enclosed, cylindrical shell, which is the can body.

Further, the functional properties of the can surface, such as frictional levels in deep drawing and ironing, can surface uniformity and associated aesthetics, and the degree to which the can surface approaches the ideal condition of specular reflection of light are greatly influenced by can surface microtopography. Specifically, the lay or general direction of surface roughness, the root mean square roughness, average roughness wavelength, and shape and distribution of asperities have all been identified as parameters that significantly affect the surface aesthetics of the final product.

Metal strips and sheets are rolled in rolling mills having work rolls that physically engage the sheet to reduce its thickness. The surfaces of such work rolls are prepared for rolling by grinding operations which lead to a specific average surface roughness ($R_a$). The work roll that engages the side or face of the sheet that becomes the inside surface of the can generally has a roughness of about 22 microinches. This work roll roughness is transferred to the sheet surface during rolling of the metal strip. The grinding process generally imparts a directional roughness on the roll surface which, when subsequently used to roll sheet, transfers the lay of this roughness to the sheet surface. The lay of the roughness is generally oriented in the direction of rolling. Currently, can sheet manufacturers are generally of the opinion that this longitudinal sheet roughness provides an acceptable appearance and acceptable frictional characteristics for the can making operation. Their opinions are based on their belief that the directional sheet surface roughness will not be significantly apparent to the naked eye after the can is painted and coated with a light base coating, e.g., lacquer.

A longitudinal roughness on a sheet surface, however, still leads to several undesirable affects. This is in regard to can surface aesthetics and in the can manufacturing process itself. Specifically, a random, longitudinal roughness leads to what is known as "bleed through", which are dark, irregular areas on the exterior surface of a decorated side wall of a finished can. These areas, which indicate a significant and often irregular roughness deviation in the can surface roughness, are particularly evident when white and other substantially light colors are employed to paint the can surface. The paint or coating does not properly cover regions of the can surface which have bleed through. Hence, the term "bleed through" appropriately describes this situation since the paint or coating seems to disappear into the surface as if the surface were bleeding to the inside of the can. The poor surface aesthetics caused by bleed through can result in rejection of the cans by the brewery or soft drink customer.

It is generally believed that bleed through results from two major surface defects which simultaneously appear on a can sidewall to varying degrees. The first is the rather common "looper lines" that are generally parabolic-shaped, parallel lines or "thumb prints", which occur on both sides of the can wall at a 90° angle to the direction in which the sheet was rolled. Looper lines, which are shown in FIG. 2 of applicant's drawings, are generally associated with the aforementioned directional roughness lay on the sheet surface and the deformation path through which the sheet is taken during the can making process.

An additional problem associated with directional sheet surface roughness lay is that it promotes a differential friction effect along the individual surfaces of the can in the process of forming the can since the roughness lay curves relatively to the longitudinal axis of the can. The individual surfaces refer to the sheet/die, i.e., sheet/ironing ring interface, which involves the exterior can surface, and the sheet/punch interface, which involves the interior surface of the can. It is known that if the roughness lay is in the direction of motion of the punch of the can making machine that forms sheet material into a cylindrical shell, less lubricant will be entrapped in the punch/sheet interface since the sheet surface allows lubricant to relatively freely flow in the direction of punch movement, and hence a higher frictional force will be present. If, on the other hand, the sheet surface roughness lay becomes perpendicular to the direction of punch movement, thereby forming looper lines, then more lubricant becomes trapped in the interface so that friction forces are less. Because of this differential entrapment of lubricant along each of the can wall surfaces, a variable surface appearance results and is clearly manifested on the exterior surface of the can, which is most readily apparent to the naked eye.

The second major surface defect which contributes to bleed through consists of an irregular surface roughness that randomly appears on the can exterior. This roughness pattern is generally associated with the tribology of the can making process itself as well as the rolling operation. Upon close examination, this second defect consists of a local increase in surface roughness in the form of a random collection of discrete fissures or microcracks in the sheet surface. Such microcracks are typical of metal surfaces that have been worked in a mixed film lubrication regime. A mixed film regime is discussed below. The microcracks generally degrade the reflectivity of the metal surface and the subsequent brightness of the can surface since microcracks diffuse incident light, thereby making the can less desirable to the customer and therefore less marketable.

In the mixed film lubrication regime, part of the forming load is carried by contacts between a tooling surface and surface asperities of the workpiece. The remaining part is carried by a thin, locally continuous film of pressurized lubricant entrapped around the asperity contacts. The tribology of the asperity contacts is considerably different from that involving thin, pressurized lubricant films. In the case where forming loads are transferred by thin films, the tribology of the interface is decided by the physical properties of the lubricant and the kinematics of the can forming process. The tooling surface has little constraining influence on the deformation of the can surface, since the mating surfaces in question are locally separated by a highly compliant lubricant film. Therefore, metal grains near the surface of the can freely move relative to one another since they are not constrained by a rigid tool surface. This leads to an increase in local surface roughness. An analogous phenomenon is the edge surface of a titled deck of cards being shuffled. The result of such a phenomenon is the bright areas and fissure lines shown in FIG. 6 of applicant's drawings.

The surface roughening problem is unique to metal forming processes and has been consistently misinterpreted by those working in the aluminum industry, for example, as being defects resulting from mechanisms such as: agglomeration of aluminum fines into dark surface streaks, pressed or ironed-in debris, surface oxides, ineffective cleaners, and particle accumulation on tooling surfaces.

It is then concluded that two distinct processes lead to the aforementioned surface roughening phenomenon referred to as bleed through in can manufacturing operations. The first is associated with the directional roll surface roughness, which has its origin in the roll grinding process. This roughness is imparted to the sheet surface during rolling under heavy thickness reductions which are typical in can sheet manufacturing. Due to the formation of the flat sheet into a cylindrical shell, a portion of the roughness becomes oriented perpendicular to the direction of the can forming tool (i.e., the punch). This results in the thumb print discussed earlier. The second is that with higher viscosity lubricants, roughening of the workpiece surface results from the differential deformation of individual surface grains of the workpiece and hence to observed microcracks or fissures.

Process lubricants in the can making industry have bulk viscosities in the range of 43 to 130 centistokes at roughly 40° C. Additive components and base materials used in these lubricants can change the overall viscosity dramatically during the course of can manufacturing. Products of chemical degradation can have viscosities which exceed those of the original mixture (e.g., fatty acid soaps). In general, individual additive components and products of chemical degradation may have a substantial influence on the effective lubricant viscosity in the tooling/workpiece interface. The existence of thin lubricant films implies that the lubricant viscosity in the interface greatly exceeds the bulk lubricant viscosity. This drives some areas of the system into a mixed film regime.

Can manufacturers are steadily increasing cupping and body making speeds in order to improve process efficiency. An increase in such speeds also leads to thin films of lubricant locally entrapped between the can sidewall surface and forming die (i.e., ironing ring). Any increase in film thickness causes fissuring in the sheet surface since the surface is unconstrained by the tool surface, as the can surface is separated from the tool surface by the thin film.

More particularly, entrained lubricant thickness in forming operations imposed upon sheet material increases with increasing speed. This is clearly evident from the following relation for the initial, instantaneous, central film thickness h which separates the punch and the sheet surfaces in an axisymmetric stretch forming operation:

$$h = 1.22R\sqrt{\frac{\mu U}{\sigma d}}$$

where

R = the punch radius, $\mu$ = the lubricant viscosity,

U = the speed at which the punch strikes the flat sheet surface, $\sigma$ = the engineering plastic flow stress of the sheet, and d = the initial sheet thickness.

Although the above equation is appropriate for axisymmetric stretch forming, the initial film thickness in a deep drawing operation is similarly dependent upon the listed process parameters. Increasing the speed of the process therefore increases the thickness of the entrained film. A similar increase in lubricant viscosity also produces a thicker lubricant film.

SUMMARY OF THE INVENTION

In the can manufacturing process, a bright, substantially fissure-free (i.e. less than 0.25% is covered with fissures) container (can) side surface with a high distinctness of image is generated when both the sheet rolling and can manufacturing processes are conducted in the boundary film lubrication regime. The looper lines or thumb print are substantially minimized or even eliminated by engineering the surface of the roll used to roll the can sheet such that it no longer has a substantially directional roughness lay. This also induces a substantially compressive residual stress on the sheet surface which tends to prevent fissure formation during can manufacturing. The latter improvement is described in applicant's U.S. Pat. No. 5,025,547, the contents of which are hereby incorporated into the present application by reference. Also, the evolution of microcracks or fissures in the sheet rolling operation is described in applicant's U.S. Pat. No. 4,996,113 which is also incorporated in the present application by reference. We therefore limit the discussion of the present application to the can manufacturing process itself.

A significant amount of fissuring is therefore prevented since the process does not operate in the mixed film lubrication regime. The evolution of microcracks during rigid container manufacturing is therefore controlled in the manufacturing process with a carefully engineered friction gradient existing between the die-/exterior-can-surface interface and punch/inner-can-surface interface. Such a friction gradient is provided and controlled with minute depressions in that surface of the can sheet which is to become the exterior wall of the finished can, and a directional roughness lay on that surface of the can sheet which is to become the interior wall of the can. The depressions, which are imparted to the sheet surface during rolling, are generally not discernable by the naked eye. They provide minute reservoirs of lubricant which lower friction levels along the exterior wall of the can while the directional roughness elevates friction levels along the interior wall of the can, as it is formed. This leads to the desired friction differential.

During the can forming operation, differential frictional characteristics between the inner and outer surfaces of the forming body are highly desirable to improve metal flow while at the same time minimizing tensile stress in the sidewall of the can. For example, sidewall tensile stress in the process of ironing a can body in a boundary lubrication condition is given by $\sigma_w$, which is written as:

$$\sigma_w = \frac{2\sigma}{\sqrt{3}}\left[\ln\left(\frac{d_i}{d_f}\right) + \frac{1-\cos\alpha}{\sin\alpha} + \frac{m_{cd}}{2}\left\{\frac{\cos\alpha}{\sin\alpha}\ln\left(\frac{d_i}{d_f}\right) + \frac{L}{d_f}\right\} + \frac{m_{cp}}{2\sin\alpha}\ln\left(\frac{d_i}{d_f}\right)\right]$$

where $\sigma$ = the engineering plastic flow stress of the sheet material, $d_i$ = the initial sheet thickness (before ironing), $d_f$ = the final sheet thickness (after ironing), $\alpha$ = die entry angle or angle of ironing ring surface relative to the exterior can surface, L = length of the die land or length of ironing ring over which can and die (i.e., ironing ring) make intimate contact, $m_{cd}$ = friction factor at interface between can and ironing ring surfaces, $m_{cp}$ = friction factor at interface between can and punch surface.

The friction factor $m_{cd}$ relates the shear stress between the exterior surfaces of the forming can and the die or ironing ring surface to the plastic flow stress of the sheet and is thus a measure of friction in an averaged sense. Similar observations may be made about $m_{cp}$. For fixed values of $d_i$, $d_f$, L, $\sigma$, and $\alpha$, the above equation predicts that when the friction gradient or differential friction between the can exterior and interior surfaces, which is defined by the difference in friction factor or $\Delta m = m_{cp} - m_{cd}$, is negative, meaning that the friction at the can/die interface is greater than the friction at the can/punch interface, that the sidewall stress $\sigma_w$, which is a tensile or "stretching" stress, will increase during the ironing process. This simultaneously increases the likelihood that the can wall will develop a tear leading to interruption of the can making process followed by equipment downtime as the torn cam must be physically extracted from the forming press.

Additional undesirable consequences from a negative differential friction are found in the lower thickness reductions which are possible during ironing, requiring that the press be re-tooled, and greater energy input required for the deformation process. On the other hand, if a positive differential friction exists, i.e., the friction at the can/punch interface is greater than the friction at the can/die interface, then the sidewall stress in the can is lowered thereby reducing the likelihood of a tear in the wall of the can. In addition, greater thickness reductions can be made requiring less energy input with more uniform deformation of the can sidewall.

A nearly isotropic surface roughness of that surface of the sheet which becomes the exterior surface of the can, for example, provides more uniform frictional forces along the can circumference. This, in turn, provides better control of the metal deformation process, especially if the inner surface of the can is rougher than the surface of the can exterior since this creates a positive differential friction in the manner previously discussed. Furthermore, the lubricant film is more evenly entrapped in the can/die interface because of the isotropic surface roughness of the sheet surface, instead of being partially trapped and partially allowed to freely flow by a directional sheet roughness which is changing its orientation relative to the axis of the can as the can is formed.

Information is often stamped in the exposed surfaces of the lids of aluminum and steel cans that provides instructions for opening the can, manufacturing location, brand name, and recycling instructions. The widths and depths of the letters and numerals of this consumer information is on the order of several thousandths of an inch or several orders of magnitude larger than the average surface roughness of the lid. Occasionally, a rough roll grind imprinted onto the sheet surface during a large thickness reduction rolling process will interfere with the visibility of information stamped in the lid. This causes the letters and numbers of the information to become difficult to read and sometimes totally illegible. A quasi-isotropic, generally non-oriented roughness will greatly enhance the legibility of the stamped information.

An objective of the invention is to produce a strip surface having the following characteristics: (1) greatly improved drawability and ironability, and hence less energy input required during can manufacturing, leading to the potential use of a thinner gauge sheet product or even "harder" alloys, such as aluminum alloy 5182, outside of what are typically used (e.g. aluminum alloy 3004 for the can body), (2) a substantially isotropic, non-directional surface texture involving a generally uniform distribution of micron-sized depressions in a smooth nominal surface (3) a compressive residual stress in the strip that prevents or at least substantially reduces microcrack formation during the can making process, and (4) enhanced surface uniformity and brighter surface appearance for both container body and lid stock.

Such a surface is created by rolling the strip between work rolls of a rolling mill, with at least one of the work rolls having an average roughness of less than ten microinches. A two dimensional surface topography of depressions and surrounding raised portions is generated on the work roll surface with the focused beam from either a laser or electron beam source appropriately directed to the surface. Following the focused energy beam processing, a light grinding, mechanical polishing or chemical polishing operation is employed to remove any recast, loose material and debris from the roll surface generated by impact of the energy beam. The work roll is then coated with a hard, dense material that serves to prolong wear life of the roll by minimizing wear of the roll surface, and coats each depression and the raised portion that surrounds it. When a strip or sheet of metal is rolled with such a roll surface, the raised portions form configured depressions in the sheet corresponding to the raised portions on the roll surface, but which become elongated in the rolling direction because of a smearing action that takes place between roll and sheet surfaces during heavy thickness reductions. Such smearing and a non-directional surface appearance produce a high degree of brightness and distinctness of image on the sheet surface.

The surface of the strip with the depressions is intended to become the outside surface of the can body, the depressions functioning as microscopic lubricant pockets or reservoirs that expel lubricant into the land region or the region of contact between the can and ironing rings surfaces. This induces a relatively low friction factor between the can exterior and the ironing ring land. The opposite surface of the sheet, which becomes the inside surface of the can, has a directional surface topography from the rolling process which provides a larger friction factor at the interface between the can/punch surfaces. This leads to the aforementioned positive differential friction effect required to enhance ironability. The inside can surface will not be visible and hence is not required to meet the rigorous surface aesthetics of the can exterior. The minute pockets of lubricant at the can exterior/die surface prevent adhesive metal transfer of workpiece material to the die surface. In the case of end (lid) stock, a quasi-isotropic surface, with enhanced brightness, will highlight any embossed letters or numbers stamped in the lid surface thereby making these characters much easier to read, as compared to a surface having a ground finish as a background, since the characters will not blend into the imprinted roughness of the ground roll surface.

BRIEF DESCRIPTION OF THE DRAWINGS

The invention, along with its objectives and advantages, will be better understood from consideration of the following detailed description and the accompanying drawings in which.

PREFERRED EMBODIMENT

Figure 1:
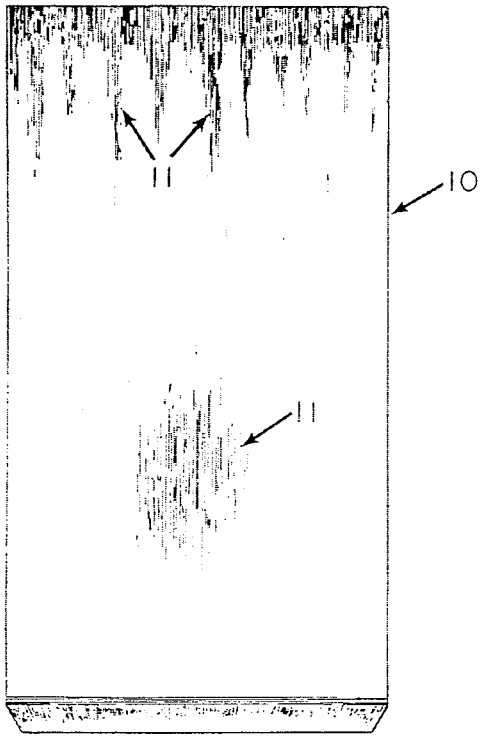
FIG. 1 is a drawing of an unpainted exterior sidewall of a drawn and ironed aluminum rigid container having a dull, fissured surface.
Figure 2:
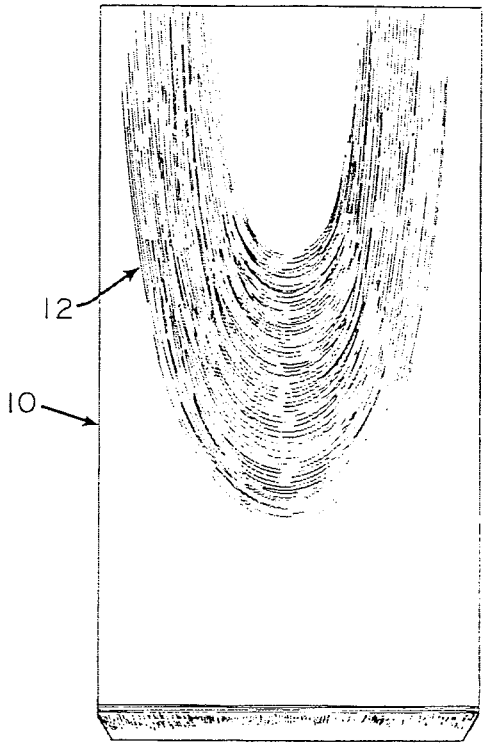
FIG. 2 is a drawing of a drawn and ironed aluminum rigid container showing the general nature of "looper lines" on an unpainted, uncoated exterior surface of the container.
Figure 3:
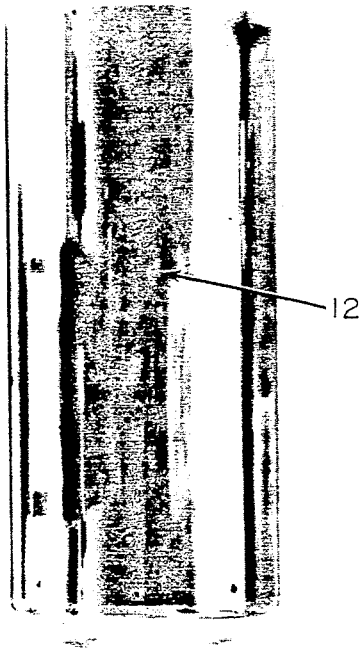
FIG. 3 is a photograph of an unpainted drawn and ironed aluminum can, with the looper lines of FIG. 2 being visible on the exterior sidewall of the can.
Figure 4:
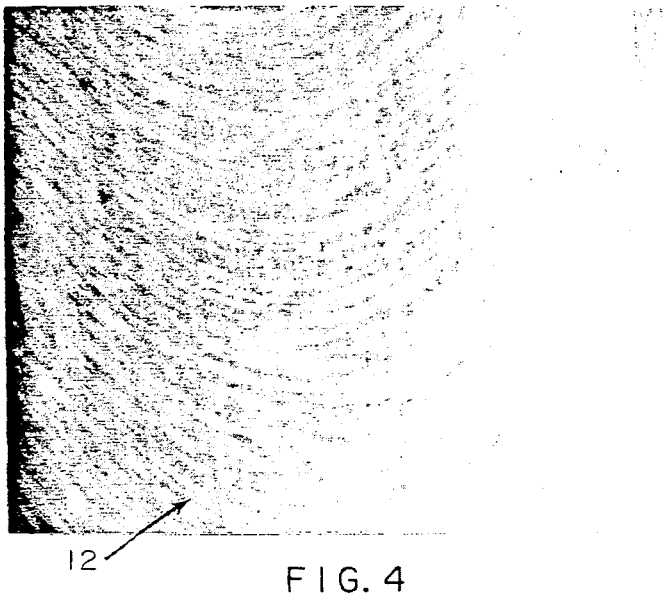
FIG. 4 is a photomicrograph of a surface portion of the can of FIG. 3 showing the looper lines, the surface image being magnified one hundred times.
Figure 5:
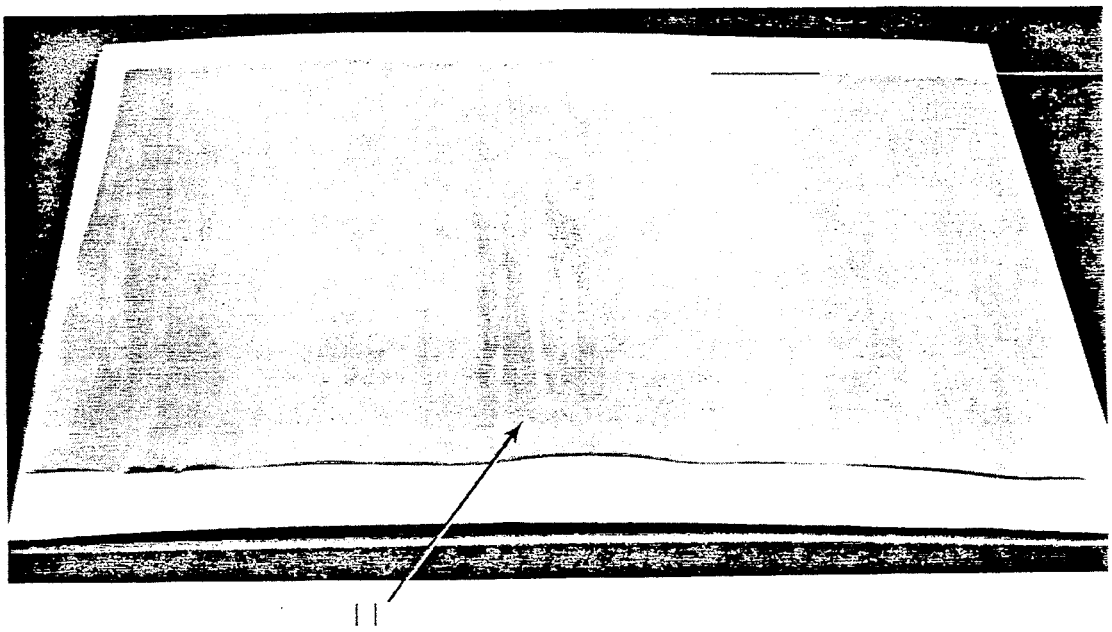
FIG. 5 is a photograph of an ironed can sidewall showing the dark, fissured regions of the surface depicted in FIG. 1, the sidewall having been slit along the axis of the can and substantially flattened.

Referring now to FIGS. 1 and 5 of the drawings, a drawn and ironed aluminum can body 10 is depicted in which the exterior surface of its sidewall has dark, rough areas 11. The dark areas include fissures, as discussed below, all of which create a non-uniformly dull, unattractive can. In FIGS. 2 and 3 of the drawings, a can body 10 is shown in which the exterior can sidewall contains a thumb print or parabolic looper lines 12. FIG. 4 shows the lines in clearer form, as the lines are magnified one hundred times. Surface fissures and looper lines produce a dull metal surface and an irregular, somewhat dark undercast on a painted can surface, and leads to the bleed through problem discussed above.

Looper lines 12 result from a general roughness of the strip surface that extends in the direction in which the strip was rolled, and the deformation path through which the strip is taken in the can making process. The surface roughness lay is generated during the rolling process and promotes a differential friction effect along the can wall in the process of forming the can, since the roughness lines curve relative to the axis of the can. As explained earlier, if the surface roughness lay is substantially parallel to the direction in which a can forming punch (not shown) deforms the rolled sheet into a cylindrical shell, then the amount of lubricant retained in the tooling/workpiece interface will be small and frictional force will be high. If, on the other hand, the surface roughness lay is substantially perpendicular to the direction of punch travel, then more lubricant is trapped in the interface resulting in a lower average friction.

Figure 6:
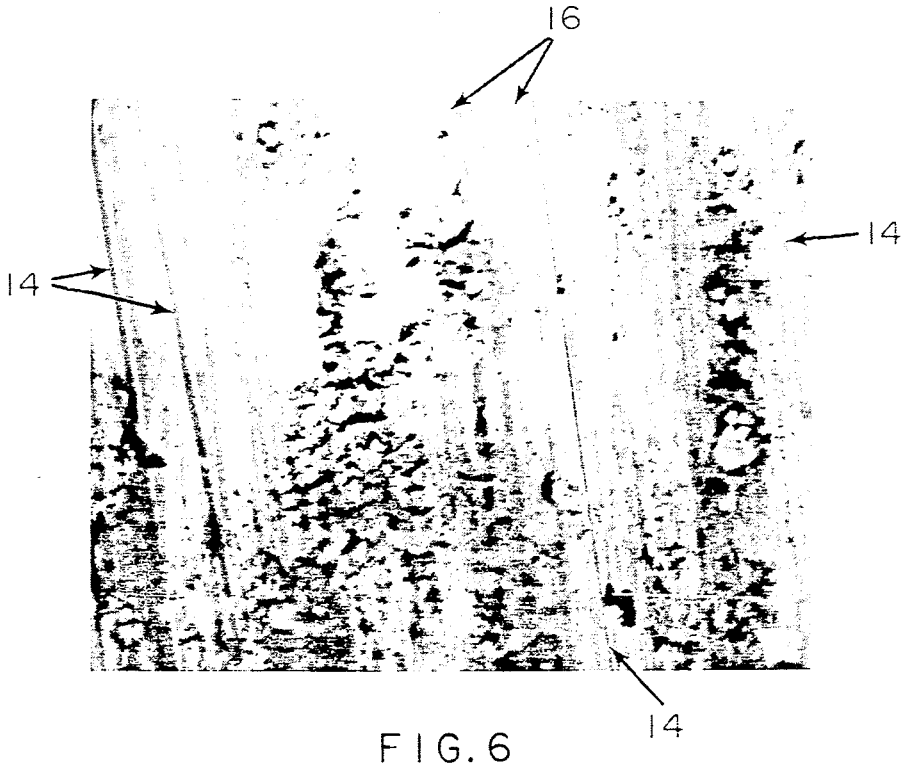
FIG. 6 is a scanning electron micrograph (SEM) of the surface of a sidewall of a drawn and ironed aluminum can showing random, transverse fissures the surface image being magnified 3000 times.

As discussed above, the second type of defect found in a can sidewall surface is an irregular, random roughness in the form of discrete, minute fissures or microcracks. These are illustrated in FIG. 6 of the drawings by reference numeral 14. The figure is a scanning electron micrograph of a portion of the ironed surface of a 3004 aluminum alloy exterior can sidewall at 3000× magnification. As shown, the surface is a conglomeration of microfissures and cracks 14 separated by random, relatively bright areas 16 which are regions that are rich in alloying agents such as magnesium. The overall result of such a surface is a relative dullness, i.e., dull areas, as the fissures and cracks diffuse incident light. The dull areas, which are in sharp contrast with the bright areas, promote a nonuniform can surface appearance, as shown in FIGS. 1 and 5.

Figure 7:
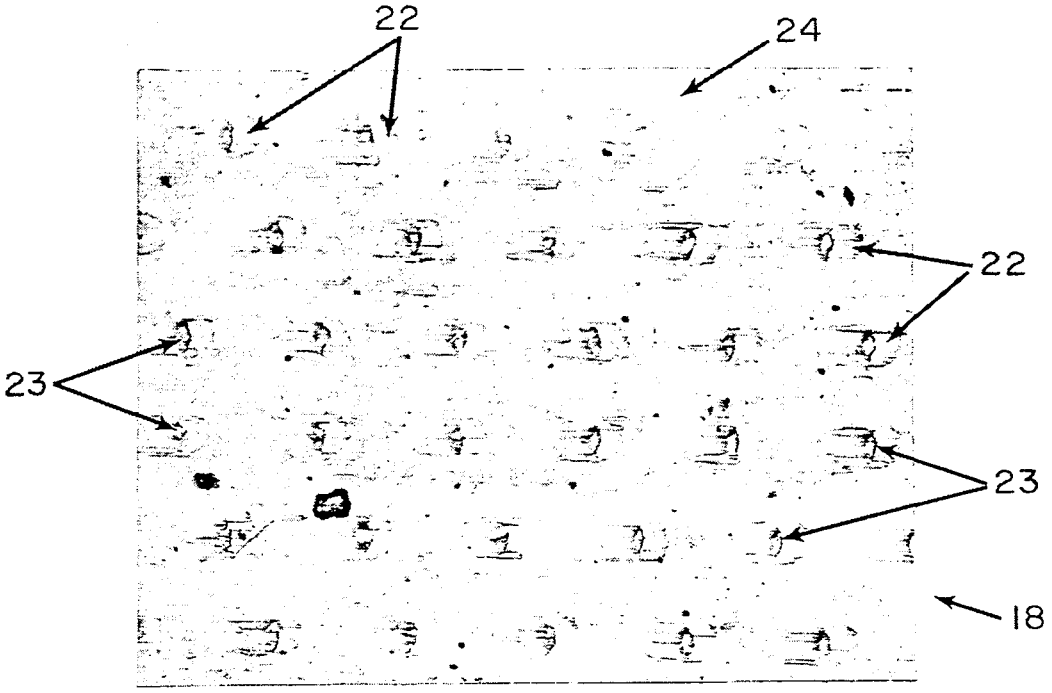
FIG. 7 is a photomicrograph of a surface of a sheet of 3004 aluminum alloy rolled in accordance with the invention, the surface image being magnified one hundred times.

In accordance with the invention, can surface problems associated with a directional roughness lay and random fissures are alleviated by first providing the surface 17 (FIG. 9) of the work roll that rolls a strip or sheet 18 (FIG. 7) with a substantially smooth background surface finish, the roughness of which is less than ten microinches on average. Still referring to FIG. 9, the roll surface is next provided with a plurality of nearly evenly spaced, discrete, micron-sized generally ring shaped raised portions 19 that respectively surround central depressions 20. The raised portions imprint the surface of sheet 18 with elongated micron-sized depressions or pockets 22, as shown in FIG. 7. The elongation of the pockets in FIG. 7 is visible upon close examination of the figure. The depressions in the roll surface form corresponding raised portions 23 in the general center of each depression 22. The substantially smooth roll surface between raised portions 19 produces a similar finish 24 on the sheet surface in the areas between depressions 22 so that there is generally no significant background roughness due to the roll grind imprinted on strip 18. A minimal background roughness may appear due to the roll coating used, as the coating itself is not perfectly smooth. This is in stark contrast to the 2xxx series aluminum sheet surface depicted in FIG. 8, i.e., surface 26 and the heavy directional roll grind lines 28, as shown therein. The sheet contains central flat regions 30 surrounded by annular moats with variable depths 31 formed by circular raised portions (not shown) provided on the surface of a work roll.

Figure 9:
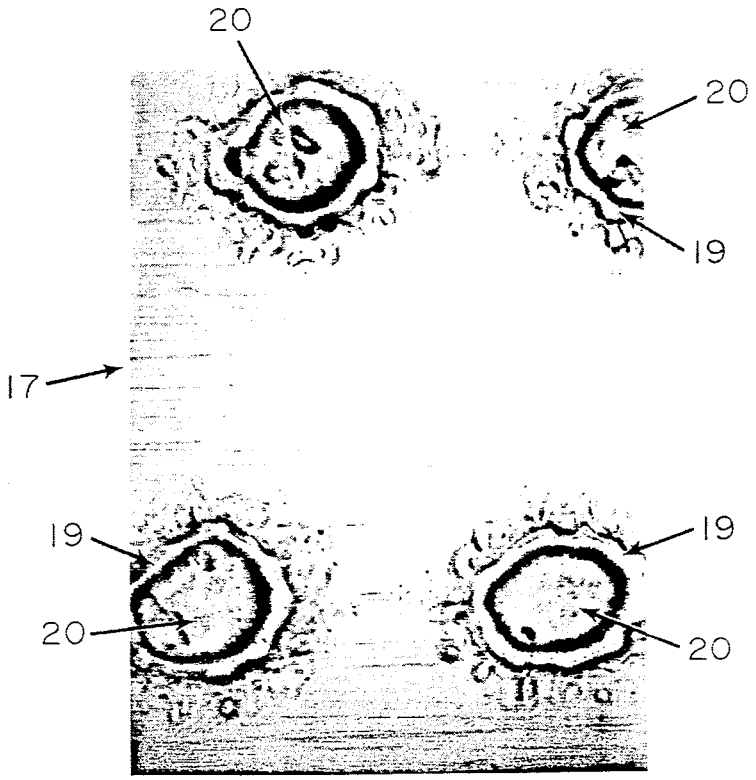
FIG. 9 is a photomicrograph of the mirror finished surface of a 52100 tool steel roll textured with a single electronically pulsed Nd:YAG laser beam operating at 1.064 microns; the surface image is magnified two hundred and twenty five times.
Figure 10:
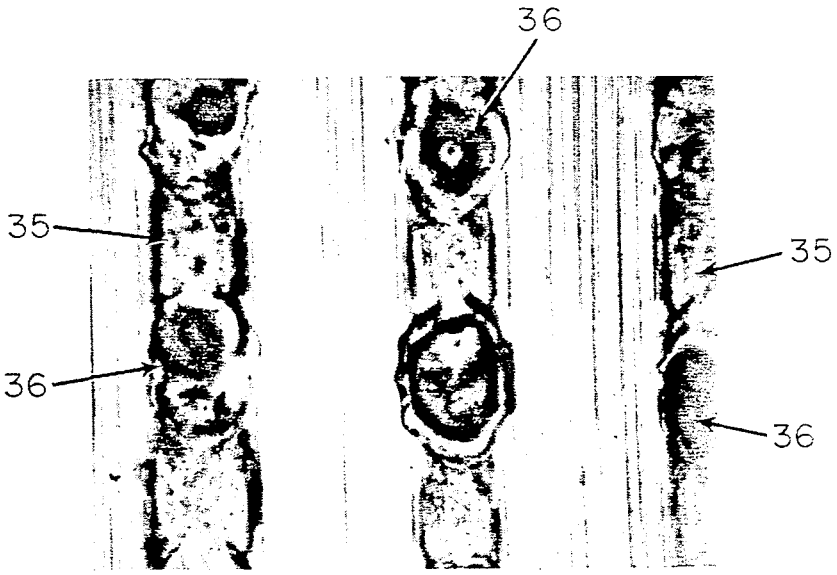
FIG. 10 is a photomicrograph of the mirror finished surface of a 52100 steel roll textured with a single Nd:YAG laser beam in which Q switching of the beam is not under proper control between successive firing of the laser; the surface image is magnified two hundred and twenty five times.

The image seen in FIG. 9 is a 225×photomicrograph of a mirror finished 52100 tool steel roll surface that has been textured with a single electronically pulsed Nd:YAG laser beam operating at 1.064 microns, and directed through appropriate focusing optics. This type of texture was used to produce the sheet surface shown in FIG. 7. The roll was initially finished to an average roughness of less than ten microinches so that no significant transfer of the roll grind would occur during rolling. The average spacing between craters is 254.0 microns and the craters are 60.0 microns in diameter on the average. Crater depth is 3.0 microns on the average. Unlike the texture shown in FIG. 10 there is substantially no melted track 35 connecting successive craters 36 on the roll surface. The melted track is due to inappropriate control of the electronic pulsing medium, i.e., the Q-switch within the laser, and will partially imprint the can sheet surface under the aformentioned heavy reductions associated with can sheet rolling; track 35 will hence be clearly visible to the naked eye. The melted tracks, in addition, causes Moire' fringes since the spacing between successive sections of the melted tracks will vary across the roll surface due to inaccuracies in the apparatus employed to articulate the roll relative to the laser beam. (Moire fringes are discussed in a textbook entitled "Moire Analysis of Strain" by A. J. Durelli and V. J. Parks, 1970, Prentice-Hall, Inc., Englewood Cliffs, N.J.) This variation in track spacings is transferred to the sheet surface and will be visible on the exterior can surface when the can is formed. Such tracks and fringes reduce the quality and aesthetics of the can, i.e., the exterior surface should be bright and smooth such that the only items visible to the consumer is information painted or printed on the exterior surface.

The elongated impressions 22 formed in the surface of an aluminum strip, as shown in FIG. 7, are a result of the "bulk" reduction of the sheet in a rolling mill, one work roll of the mill having the texture depicted in FIG. 9. Generally, the uniformity of the ring of the raised portions on the roll surface would ordinarily be transferred to the strip or sheet surface. This is the case with light reduction temper rolling of steel or aluminum sheet, which produces the surface shown in the micrograph of FIG. 8. However, with the high speed, massive reductions involved in many steel and aluminum rolling operations, the depressions formed in the metal surface are elongated for reasons explained hereinafter. Such massive or bulk reduction refers to large reductions in thickness of the sheet. The thickness of the sheet depicted in FIG. 7 was reduced 35%, while that of FIG. 8 was "temper rolled" at 2.7%. Under the minimal, latter reduction, depressions 31 were simply imprinted on top of the original ground surfaces created in the previous rolling operation.

Figure 8:
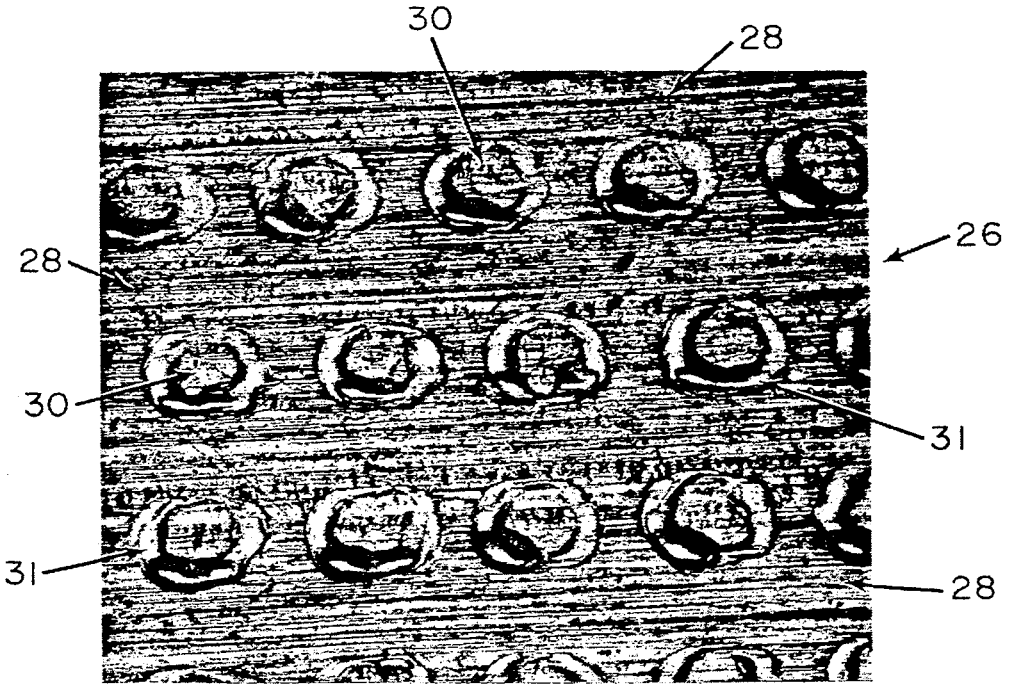
FIG. 8 is a photomicrograph of a portion of a 2xxx aluminum alloy sheet rolled with a work roll textured with the mechanically pulsed beam of a $CO_2$ laser, the surface image being magnified one hundred times.

In addition, the light reduction used to produce the surface shown in FIG. 8 is such that the ring-shaped texture formed in the surface retains a significant degree of structure, which structure is substantially opposite to that of the roll surface texture (not shown). This nearly perfect imprint of the roll texture, i.e., the central flat region surrounded by annular moats, onto the sheet surface shown in FIG. 8 is primarily due to the very low degree of relative sliding that occurs between the sheet and roll surfaces since only very minimal plastic deformation of the sheet is involved. The nearly circular shapes in FIG. 8 correspond to the nearly circular raised portions formed on a work roll with a mechanically pulsed $CO_2$ laser beam. Such processes are disclosed in U.S. Pat. Nos. 4,322,600, 4,795,681, 4,806,724, 4,841,611, and 4,917,962 issued, respectively, in the names of Crahay, Furukawa et al., Kawai et al, Braggard et al., and Kusaba et al.

Other publications on $CO_2$ texturing are "Present State of Development of the Lasertex Process by Crahay et al. (Proceedings of the Third International Conference of Lasers in Manufacturing, Jun. 3 to 5, 1986 in Paris, France), and "Gravure de las Rugosite des Cylinders de Laminoir par Impulsions Laser", by Crahay et al., published in the March, 1983 issue of "Revue de Metallurgie-CIT, pages 393 to 401.

The temper rolling process is, hence, basically an imprinting or coining process during which a texture opposite to that of the roll surface roughness is substantially imparted to the sheet surface. The result of a bulk reduction process, such as shown in FIG. 7, substantially elongates the surface depressions at high sheet thickness reductions (e.g. 10–70%), thereby eliminating the need for significant changes in reduction schedules, simply to accommodate the texture, while still offering the ability to trap lubricant in a can forming operation and subsequently effect a positive differential friction gradient between the interior and exterior can sidewalls and the respective working tools during ironing processes.

In bulk reduction processes, the workpiece surface slides relative to the roll surface during rolling. Due to the volume constancy of plastic deformation along the roll bite, the speed of the workpiece increases from its entry into the rolls to its exit from the bite. There is a location within the roll bite, known as the neutral point, at which the surface velocities of the roll and workpiece are equivalent. Prior to reaching this neutral point, the roll surface moves faster than the workpiece surface in the rolling direction. After the material of the workpiece passes the neutral point, the workpiece surface moves faster than the roll surface. Because of this differential speed effect in the roll bite, the roll surface tends to smear the workpiece surface. This phenomena is discussed in some detail in Applicants' U.S. Pat. No. 5,025,547 issued Jun. 25, 1991.

The smearing action elongates the depressions formed in the sheet by the roll that forms the quasi-isotropic texture of FIG. 7 while simultaneously tending to brighten the sheet surface in the process of the final rolling step of a cold mill. From the last stand in a cold mill, the sheet is wound and made ready for delivery to the can manufacturing customer or for re-oil processes.

The rolling process, in addition, is conducted in the boundary film regime disclosed in applicant's above cited U.S. Pat. No. 4,996,113. As disclosed, rolling in a boundary film lubrication regime prevents free surface deformation and creates compressive residual stresses in the strip surface that retard the formation of minute fissures and microcracks in the can surface as the can body is formed.

The quasi-isotropic sheet surface roughness of the invention prevents entrapment of excessive quantities of lubricant at the sheet/die interface when compared with a conventional sheet surface having a directional roughness lay. The conventional surface roughness preferentially traps lubricant at the sheet/die interface since a portion of the initial surface roughness lay becomes perpendicular to the direction of the punch employed to change the sheet into a cylindrical shell.

The micron-sized, raised portions 19 created around depressions 20 formed in the smooth surface of the roll of FIG. 9 are made by a narrow, focused, electronically pulsed electron or laser beam such as a Nd:YAG (yittrium aluminum garnet) or Nd:YLF (yittrium lithium fluoride) laser. (A fundamental difference exists between an electron beam and a laser beam, the former consisting of a beam of matter, i.e., electrons, while the latter is a beam of electromagnetic radiation having matter-like properties, i.e., photons.) The impact of the beam against the roll surface induces movement of a minute amount of surface material from the region directly in the path of the beam to a peripheral location of the impact area. This forms a depression (20) beneath the beam and a raised circle or lip (19) around the depression; the two elements are collectively referred to as "a crater".

The minute raised portions or lips formed in the substantially smooth (mirror) surface of the roll have an average diameter, i.e., distance between opposed inner edges of the lips, on the order of 10 to 1000 microns, and a height of one to ten microns. The raised portions are generally uniformly spaced, the spacing between adjacent craters being on the order of 10 to 2000 microns and placed relative to one another in either hexagonal cell patterns or rectangular cell patterns, for example the raised portions must be smooth and shallow enough so as not to induce fracture sites in the sheet, as it is formed into a can.

After the raised portions are formed, the surface of the roll is lightly polished to remove any debris created by the impact of the beam against the roll surface, including any vaporized material that may have been deposited on the raised portions. In rolling aluminum sheet, it is particularly important that the work rolls be free of debris, since any debris remaining on the roll surface when a wear resistant coating is applied to the roll surface, generates, in combination with the coating, sharp, protruding edges. These edges act as micro-cutting tools which micromachine the sheet surface inside the roll bite, leaving a very dirty residue (known as smudge in the rolling industry) and an undesirable sheet product. Further, since the debris is only loosely bonded to the roll surface, it subsequently detaches from the surface thereby creating voids on the coated surface. The voids then entrap wear debris and this debris is retransferred to the sheet surface in the roll bite resulting in a very dirty and undesirable sheet product.

The light polishing step can be performed in a number of ways or combination of ways, such as lapping, power brushing, chemical etching or polishing, etc. The result is a substantially clean roll surface.

A layer or coating of a hard, dense material such as chrome is typically applied to the roll surface. The thickness of the layer applied here is on the order of 0.0005 inch, which is effective to prolong the useful life of the roll surface, including the life of the raised portions formed on the surface. This is accomplished economically, as (1) the volume amount of coating material is not substantial, and (2) the corresponding extension of the life the roll provides savings that greatly outweigh the cost of the coating material.

The dense layer conforms generally to the depressions and annular raised portions provided on and in the roll surface so that they, like the roll surface in general, have a prolonged wear life, while simultaneously being able to form micron-sized depressions 20 in a sheet surface when the sheet is bulk rolled between two work rolls of a rolling mill.

The surface configuration shown in FIG. 7 is rolled into that surface of the sheet which is to become the can exterior, i.e., that surface which will come into contact with the lands of ironing rings in the process of ironing the can. That surface of the sheet which becomes the interior wall of the can is provided with a conventional roughness imparted from a ground roll surface, i.e., a surface having a directional roughness lay. The average roughness of the inside sheet surface exceeds that of the outside sheet surface such that a significant positive differential friction gradient exists between the two surfaces and the respective working surfaces in order to promote a more uniform deformation of the sheet during drawing and ironing and to prevent tearing of the can wall.

On the outside of the container body surface in the can forming operation, the tooling (female drawing dies and ironing rings) flattens the can surface in a process that removes depressions 20 and raised portions 22 thereby releasing minute amounts of lubricant in the interface between the container surface and rings. Since the only lubricant available to the interface resides in elongated depressions 20, which are appropriately spaced to provide generally uniform lubrication of the forming interface, the elongation and thinning of the container wall is substantially uniform, even though there is metal-to-metal contact between the smooth surface areas 24 of the sheet surface and the working surface of the ironing rings. As discussed earlier, the rings engage and smear the container surface in the process of ironing the can sidewall such that the compressive stresses in the sidewall surface are maintained to prevent or at least substantially reduce minute fissuring of the can surface.

The smearing, in addition, enhances the brightness of the surface, making the can more appealing to the can maker, and eventually, to the consumer.

Since the sheet from which cans are formed does not contain directional roll grind marks, the bleed through problem caused by the fissures of FIGS. 1 and 5 and the thumb print pattern of FIGS. 2 through 4 are no longer of concern.

Hence, microcracks and directional roll marks are substantially eliminated from one surface of the sheet and subsequently the can product of the invention. By the processes of the invention, the likelihood of can sheet customer rejection on the basis of unacceptable quality of the can exterior is substantially reduced if not eliminated.

While the invention has been described in terms of preferred embodiments, the claims appended hereto are intended to encompass all embodiments which fall within the spirit of the invention.

What is claimed is:

1. An aluminum sheet for making rigid container products, said sheet having at least one fissureless surface produced by rolling in a boundary lubrication regime and a lubricant retaining surface of generally uniformly spaced elongated micron-size depressions caused by bulk rolling of the sheet and consequent smearing of the sheet surface with a roll surface having a near-mirror finish and discrete, spaced apart, raised portions, the elongated depressions providing the sheet surface with a quasi-isotropic surface texture having essentially no roll grind marks that lead to bleed through after the products are painted, said texture providing (1) a substantially even distribution of friction at the interface of the textured sheet surface and the surfaces of tooling for forming rigid container products from the sheet, the textured surface providing the outside surface of the container products and a differential friction between interior and exterior container surfaces that promotes plastic flow of container metal while minimizing tensile stress in forming container products, and (2) an exterior surface having a high degree of specular reflection which provides a bright surface and distinctness of an image reflected from the surface.

2. The metal sheet of claim 1 in which the micron-sized depressions are elongated in the direction in which the sheet was rolled in a rolling mill.

3. The metal sheet of claim 1 in which the depressions have a raised portion in the general centers thereof.

4. A deep drawable aluminum sheet product having a lubricant-retaining surface of generally evenly spaced, micron-sized depressions formed by a Nd:YAG laser or an electron beam device in a trackless manner such that the depressions are discrete and unconnected, the product having further a substantially non-directional, quasi-isotropic surface roughness and texture formed by rolling with a work roll in a rolling mill having (1) a working surface provided with discrete, micron-sized, unconnected raised portions that form the micron-sized depressions in said sheet product, and (2) an average surface roughness of less than ten microinches such that the sheet product is rolled without directional roll grind marks being transferred to said product during substantial reductions in thickness in the rolling mill.

5. The deep drawable sheet of claim 4 in which the breadth of the depressions is on the order of ten to 1000 microns.

6. The deep drawable sheet of claim 4 in which the distance between successive depressions is on the order of between ten and 2000 microns.

7. An aluminum sheet for making rigid container products by the method wherein said sheet is provided with a substantially fissureless surface as the result of being rolled under boundary lubrication conditions and in the process of taking substantial reductions in the thickness of the sheet, and that retains minute amounts of lubricant in generally discrete, elongated, and substantially uniformly spaced apart micron-sized depressions provided by proper control of an energy beam employed to form micron-sized craters in a roll surface that, in turn, form the elongated depressions in the sheet surface, said depressions providing a substantially uniform distribution of friction between the surfaces of the sheet and tools employed to form the rigid container products with substantial elimination of looper lines on the product surfaces, and container product surfaces having a high degree of specular reflection of light and therefore bright surfaces provided distinctness of an image reflected from the surface.

* * * * *